US007614250B2

(12) United States Patent
Sanagi

(10) Patent No.: US 7,614,250 B2
(45) Date of Patent: Nov. 10, 2009

(54) CENTRIFUGAL FAN WITH AIR GUIDE

(75) Inventor: Tsunehisa Sanagi, Sakai (JP)

(73) Assignee: Daikin Industries, Ltd., Osaka (JP)

( * ) Notice: Subject to any disclaimer, the term of this patent is extended or adjusted under 35 U.S.C. 154(b) by 442 days.

(21) Appl. No.: 10/507,019

(22) PCT Filed: Nov. 20, 2003

(86) PCT No.: PCT/JP03/14860

§ 371 (c)(1),
(2), (4) Date: Sep. 8, 2004

(87) PCT Pub. No.: WO2004/055380

PCT Pub. Date: Jul. 1, 2004

(65) Prior Publication Data

US 2005/0103042 A1 May 19, 2005

(30) Foreign Application Priority Data

Dec. 16, 2002 (JP) ..... 2002-363488

(51) Int. Cl.
*F25D 17/06* (2006.01)

(52) U.S. Cl. ..... 62/426; 416/181; 417/368

(58) Field of Classification Search ..... 62/419, 62/426, 373, 417; 417/366, 368; 416/181
See application file for complete search history.

(56) References Cited

U.S. PATENT DOCUMENTS 7,066,712 B2 * 6/2006 Kim et al. ..... 415/58.4
2002/0141888 A1 * 10/2002 Bostwick ..... 417/366

FOREIGN PATENT DOCUMENTS

| | | | |
|---|---|---|---|
| CN | 2431523 | Y | 5/2001 |
| JP | S36-022741 | U | 8/1961 |
| JP | S54-168607 | U | 5/1978 |
| JP | S56-150888 | U | 4/1980 |
| JP | S60-164699 | U | 11/1985 |
| JP | S62-069097 | U | 4/1987 |
| JP | H06-076689 | A | 10/1994 |
| JP | H06-294399 | A | 10/1994 |
| JP | H10-153196 | A | 6/1998 |
| JP | 11-101194 | A | 4/1999 |
| JP | H11-270493 | A | 10/1999 |
| JP | 2000-205195 | A | 7/2000 |
| JP | 2000-227231 | A | 8/2000 |
| JP | 2001-295788 | A | 10/2001 |
| JP | 3270567 | B2 | 1/2002 |

* cited by examiner

*Primary Examiner*—William E Tapolcai
(74) *Attorney, Agent, or Firm*—Global IP Counselors

(57) ABSTRACT

The present invention obtains a desired cooling effect in a fan motor as well as suppresses any increase in the noise level in a centrifugal fan that sucks in air from the rotary shaft direction and blows out air in a direction that intersects the rotary shaft, and in an air conditioner provided therewith. The centrifugal fan of the air conditioner comprises a fan motor, a hub, a plurality of blades, and an air guide. The hub has cooling air holes, and is coupled to and rotationally driven by a shaft of the fan motor. The air guide guides a portion of the blown out air to the vicinity of the fan motor, cools the fan motor, and then guides the air flow so that the revolving direction velocity decreases when that air is blown out from the cooling air holes to the side of the hub opposite the fan motor.

8 Claims, 15 Drawing Sheets

CENTRIFUGAL FAN WITH AIR GUIDE

CROSS-REFERENCE TO RELATED APPLICATIONS

This U.S. National stage application claims priority under 35 U.S.C. §119(a) to Japanese Patent Application No. 2002-363488, filed in Japan on Dec. 16, 2002, the entire contents of which are hereby incorporated herein by reference.

TECHNICAL FIELD

The present invention relates to a centrifugal fan and an air conditioner provided therewith, and more particularly relates to a centrifugal fan that sucks in air from the rotary shaft direction and blows out air in a direction that intersects the rotary shaft, and an air conditioner provided therewith.

BACKGROUND ART

Conventionally, centrifugal fans provided in air conditioners and the like have been designed to promote cooling of fan motors in order to prevent overheating of fan motors during operation.

The following explains a conventional ceiling-embedded air conditioner provided with a conventional centrifugal fan that has a fan motor cooling mechanism to promote cooling of the fan motor of the centrifugal fan.

The air conditioner includes a casing that houses various constituent equipment, and a decoration panel arranged on the lower side of the casing. An air inlet is provided at the approximate center of the decoration panel. The casing is provided therein with a centrifugal fan that sucks in air from the air inlet and blows it out in the outer peripheral direction, and a heat exchanger arranged so that it surrounds the outer periphery of the centrifugal fan.

The centrifugal fan has a fan motor that is fixed at the approximate center of the top plate of the casing, and an impeller that is rotationally driven by the fan motor. The impeller principally includes a hub that is coupled to the shaft of the fan motor, a shroud that is arranged spaced apart by a prescribed spacing on the side opposite the fan motor of the hub (namely, the air inlet side), and a plurality of blades arranged between the hub and the shroud and arrayed in the circumferential direction. An opening is provided at the approximate center of the shroud so that it opposes the air inlet. In addition, the hub has a plurality of cooling air holes positioned on the outer peripheral side of the shaft and the inner peripheral side of the plurality of blades. In addition, the inner peripheral part of the hub bulges towards the side opposite the fan motor, and the fan motor is arranged so that it opposes that bulged portion. Furthermore, a hub cover is provided on the surface of the hub on the side opposite the fan motor that covers the cooling air holes in a state spaced apart by a prescribed spacing from the hub. The surface of the hub cover on the hub side has a plurality of guide blades provided so that they protrude radially.

At the centrifugal fan, air is sucked from the rotary shaft direction into the interior of the impeller via openings in the air inlet and the shroud. Further, the orientation of the flow of that sucked in air changes to a direction that intersects the rotary shaft, and that air is blown out toward the outer peripheral side of the impeller by the plurality of blades. A portion of the air blown out toward the outer peripheral side of the impeller passes through the vicinity of the fan motor and cools the fan motor due to the difference in the static pressure of the space on the fan motor side of the hub and the static pressure of the space on the side of the hub opposite the fan motor (space inside the impeller), and is subsequently blown once again into the space inside the impeller via the cooling air holes of the hub. At this time, the air being blown out from the cooling air holes is easily guided to the space inside the impeller by the ventilation action of the guide blades of the hub cover. Consequently, the quantity of air blown out from the cooling air holes increases, making it possible to increase the cooling effect of the motor (e.g., refer to Japanese Patent Application Kokai No. HEI 11-101194).

The abovementioned conventional centrifugal fan can increase the quantity of air blown out from the cooling air holes by radial guide blades provided in the hub cover, but there is a tendency for the noise level to increase.

SUMMARY OF THE INVENTION

It is an object of the present invention to obtain a desired cooling effect of a fan motor in a centrifugal fan that sucks in air from the rotary shaft direction and blows out air in a direction that intersects the rotary shaft, and in an air conditioner provided therewith, as well as to suppress an increase in the noise level.

According to a first aspect of the present invention, a centrifugal fan sucks in air from a rotary shaft direction and blows air out in a direction that intersects a rotary shaft, and includes an electric motor, a main plate, a plurality of blades, and an air guide. The electric motor has the rotary shaft. The main plate has a cooling air hole and is coupled to and rotationally driven by the rotary shaft. The plurality of blades are provided on the surface of the main plate on the side opposite the electric motor and at a position on the outer peripheral side of the radial position of the cooling air hole. The air guide, after a portion of the blown out air has been guided to the vicinity of the electric motor and has cooled the electric motor, guides the air flow so that the revolving direction velocity decreases when blown out from the cooling air hole to the side of the main plate opposite the electric motor.

In a conventional centrifugal fan, the air guide is a radial guide blade that is provided in the hub cover and, consequently the quantity of air sucked in from the cooling air hole tends to increase due to the resulting ventilation action, but the noise level also tends to increase.

The present inventors discovered that this noise is caused by turbulence in the flow when the air sucked in from the cooling air hole merges with the air sucked in from the air inlet side (the rotary shaft direction). Specifically, it was due to the following types of causes.

The air sucked in from the rotary shaft direction flows toward the rotary shaft direction as far as the vicinity of the main plate, and then the direction of the flow changes to the outer peripheral direction due to the rotation of the plurality of blades. At this time, the air sucked in from the rotary shaft direction flows as far as the vicinity of the front edge part of the blade with a revolving direction velocity of nearly zero. However, because the air blown out from the cooling air hole is scooped out by the plurality of blades and blown out toward the outer peripheral side, it has a revolving direction velocity in the rotational direction. Consequently, when the air blown out from the cooling air hole to the side of the main plate opposite the electric motor merges with the air sucked in from the rotary shaft direction, the revolving direction velocity of the air blown out from the cooling air hole disturbs the flow of the air sucked in from the rotary shaft direction, thereby increasing the noise level.

To prevent this disturbance in the flow, it is preferable to reduce the revolving direction velocity of the air blown out from the cooling air hole to the side of the main plate opposite the electric motor. Consequently, the present invention provides an air guide that, when the air that passed through the vicinity of the electric motor is blown out from the cooling air hole to the side of the main plate opposite the electric motor, guides the air so that the revolving direction velocity decreases. Thereby, the air used to cool the electric motor can be merged along the air flow sucked in from the rotary shaft direction, and the increase in the noise level can therefore be suppressed.

According to a second aspect of the present invention, a centrifugal fan sucks in air from a rotary shaft direction and blows air out in a direction that intersects a rotary shaft, and includes an electric motor, a main plate, a plurality of blades, and an air guide. The electric motor has the rotary shaft. The main plate has a cooling air hole and is coupled to and rotationally driven by the rotary shaft. The plurality of blades are provided on the surface of the main plate on the side opposite the electric motor and at a position on the outer peripheral side of the radial position of the cooling air hole. The air guide, after a portion of the blown out air has been guided to the vicinity of the electric motor and has cooled the electric motor, guides the air flow so that it is blown out toward the side of the main plate in the counter rotational direction when blown out from the cooling air hole to the side of the main plate opposite the electric motor.

In a conventional centrifugal fan, the air guide is a radial guide blade that is provided in the hub cover and, consequently the quantity of air sucked in from the cooling air hole increases due to the resulting ventilation action, but the noise level also tends to increase.

The present inventors discovered that this noise is caused by turbulence in the flow when the air sucked in from the cooling air hole merges with the air sucked in from the air inlet side (the rotary shaft direction). Specifically, it was due to the following types of causes.

The air sucked in from the rotary shaft direction flows toward the rotary shaft direction as far as the vicinity of the main plate, and then the direction of the flow changes to the outer peripheral direction due to the rotation of the plurality of blades. At this time, the air sucked in from the rotary shaft direction flows as far as the vicinity of the front edge part of the blades with a revolving direction velocity of nearly zero. However, because the air blown out from the cooling air hole is scooped out by the plurality of blades and blown out toward the outer peripheral side, it has a revolving direction velocity in the rotational direction. Consequently, when the air blown out from the cooling air hole to the side of the main plate opposite the electric motor merges with the air sucked in from the rotary shaft direction, the revolving direction velocity of the air blown out from the cooling air hole disturbs the flow of the air sucked in from the rotary shaft direction, thereby increasing the noise level.

To prevent this disturbance in the flow, it is preferable to reduce the revolving direction velocity of the air blown out from the cooling air hole to the side of the main plate opposite the electric motor. Consequently, the present invention provides an air guide that guides the air that passed through the vicinity of the electric motor so that it is blown out from the cooling air hole to the side of the main plate in the counter rotational direction with respect to the main plate. Thereby, the air used to cool the electric motor can be merged along the air flow sucked in from the rotary shaft direction, and the increase in the noise level can therefore be suppressed.

According to a third aspect of the present invention, the centrifugal fan of the first or second aspect of the present invention is provided, wherein the air guide is formed integrated with the main plate.

Forming the air guide integrally with the main plate in the centrifugal fan enables a reduction in the number of parts.

According to a fourth aspect of the present invention, the centrifugal fan of the second aspect of the present invention is provided, further including a cover that covers the cooling air hole from the side opposite the electric motor, and that is provided so that it rotates integrally with the main plate. The air guide is formed between the cover and the main plate.

According to a fifth aspect of the present invention, the centrifugal fan of the fourth aspect of the present invention is provided, wherein the air guide has a blade shape inclined rearwards in the rotational direction of the cover.

According to a sixth aspect of the present invention, the centrifugal fan of the fifth aspect of the present invention is provided, wherein the air guide has a volute blade shape.

According to a seventh aspect of the present invention, the centrifugal fan of any one of the fourth to sixth aspects of the present invention is provided, wherein the air guide is formed in the cover.

Because the air guide in the centrifugal fan is formed in a cover that is a member separate from the main plate, an increase in the noise level can be suppressed without changing the structure of the conventional main plate.

According to an eighth aspect of the present invention, an air conditioner includes the centrifugal fan of any one of the first to seventh aspects of the present invention, a heat exchanger arranged on the outer peripheral side of the centrifugal fan, and a casing that houses the centrifugal fan and the heat exchanger.

Because the present air conditioner is provided with a centrifugal fan, wherein an air guide is provided that, when the air that passed through the vicinity of the electric motor is blown out from the cooling air hole to the side of the main plate opposite the electric motor, guides the air so that the revolving direction velocity decreases, and an increase in the noise level can therefore be suppressed.

PREFERRED EMBODIMENTS OF THE INVENTION

The following explains the embodiments of the present invention, based on the drawings.

First Embodiment (1) Overall Configuration of the Air Conditioner

Figure 1:
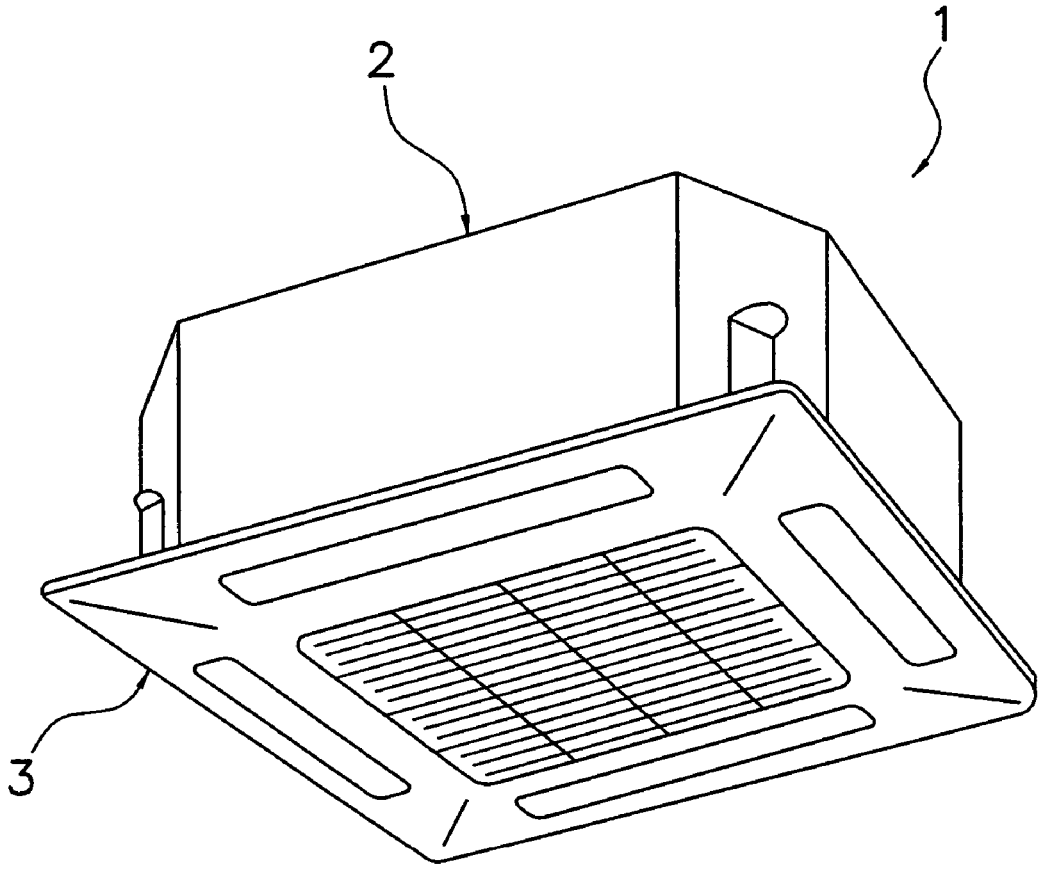
FIG. 1 is an exterior perspective view of the air conditioner according to the first embodiment of the present invention.
Figure 2:
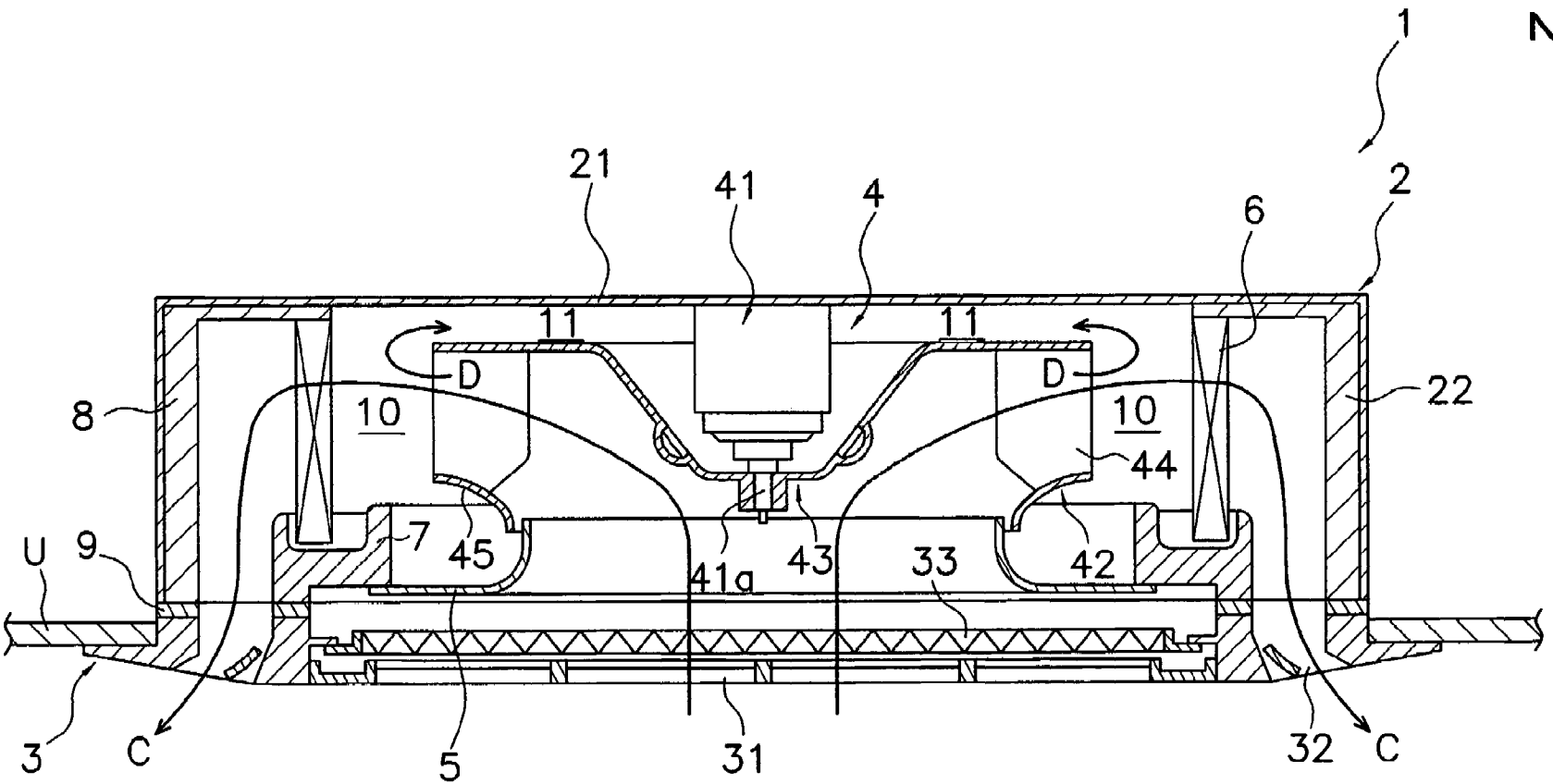
FIG. 2 is a schematic side cross-sectional view of the air conditioner according to the first embodiment.

FIG. 1 shows an exterior perspective view (ceiling is omitted) of an air conditioner 1 provided with a centrifugal fan 4 according to the first embodiment of the present invention. The air conditioner 1 is a ceiling embedded type, and includes a casing 2 that houses various constituent equipment therein, and a decoration panel 3 arranged on the lower side of the casing 2. Specifically, the casing 2 of the air conditioner 1 is arranged and inserted in the opening formed in a ceiling U in the air conditioned room, as shown in FIG. 2. Furthermore, the decoration panel 3 is fitted into the ceiling U opening.

The casing 2 has a top plate 21, and a side plate 22 that extends downward from the peripheral edge part of the top plate 21.

The centrifugal fan 4 is arranged inside the casing 2. The centrifugal fan 4 is a turbofan, and has a fan motor 41 (electric motor) provided at the center part of the top plate 21 of the casing 2, and a turbo impeller 42 that is coupled to and rotationally driven by a shaft 41*a* (rotary shaft) of the fan motor 41. The turbo impeller 42 has a disc-shaped hub 43 (main plate) that is coupled to the shaft 41*a* of the fan motor 41, a plurality of blades 44 provided at the outer peripheral part of the surface on the lower side of the hub 43 (namely, the surface on the side opposite the fan motor 41), and a disc-shaped shroud 45 that is provided on the lower side of the blades 44 and has an opening in the center part. The inner peripheral part of the hub 43 bulges toward the side opposite the fan motor, and the fan motor 41 is arranged so that it opposes that bulged part. The centrifugal fan 4 is constituted so that the rotation of the plurality of blades 44 sucks in air from the lower side of the turbo impeller 42 into the air conditioned room through the opening of the shroud 45, and blows out that sucked-in air to the outer peripheral side of the turbo impeller 42. In addition, a fan motor cooling mechanism 51 for cooling the fan motor 41 is provided in the hub 43 of the turbo impeller 42, and these details are discussed later.

A bell mouth 5 for guiding the air to the centrifugal fan 4 is arranged on the lower side of the centrifugal fan 4.

A heat exchanger 6 is arranged on the outer peripheral side of the centrifugal fan 4 so that it encircles the centrifugal fan 4. The heat exchanger 6 is connected via a coolant conduit to a heat source unit that is installed, for example, outdoors. Thereby, the heat exchanger 6 functions as an evaporator during air conditioning operation, and as a condenser during heating operation, and can thereby control the temperature of the air blown out from the centrifugal fan 4.

A drain pan 7 is arranged on the lower side of the heat exchanger 6 for receiving the drain water generated by the condensation of moisture in the air in the heat exchanger 6.

A casing heat insulating material 8 is arranged so that it is interposed between an upper end part of the heat exchanger 6 and the top plate 21 of the casing 2. The casing heat insulating material 8 extends from between the upper end part of the heat exchanger 6 and the top plate 21 of the casing 2 toward the outer side, and is arranged so that it encircles the entire inner surface of the side plate 22 of the casing 2. This prevents heat loss to the exterior from the top plate 21 and the side plate 22 of the casing 2, condensation of the casing 2, and the like.

The decoration panel 3 arranged on the lower side of the casing 2 has an air inlet 31 formed at the center part thereof, and a plurality (e.g., four) of air outlets 32 formed at the side edge part thereof. In addition, a filter 33 is provided in the air inlet 31 of the decoration panel 3 in order to eliminate dust in the air sucked in from the air inlet 31. Furthermore, a panel heat insulating material 9 is provided between the upper end part of the decoration panel 3 and the lower end part of the casing 2.

As described above, a main air passageway 10 is formed in the air conditioner 1 from the air inlet 31 of the decoration panel 3 to the air outlets 32 via the filter 33, the bell mouth 5, the centrifugal fan 4, and the heat exchanger 6.

(2) Constitution of the Motor Cooling Mechanism

Figure 3:
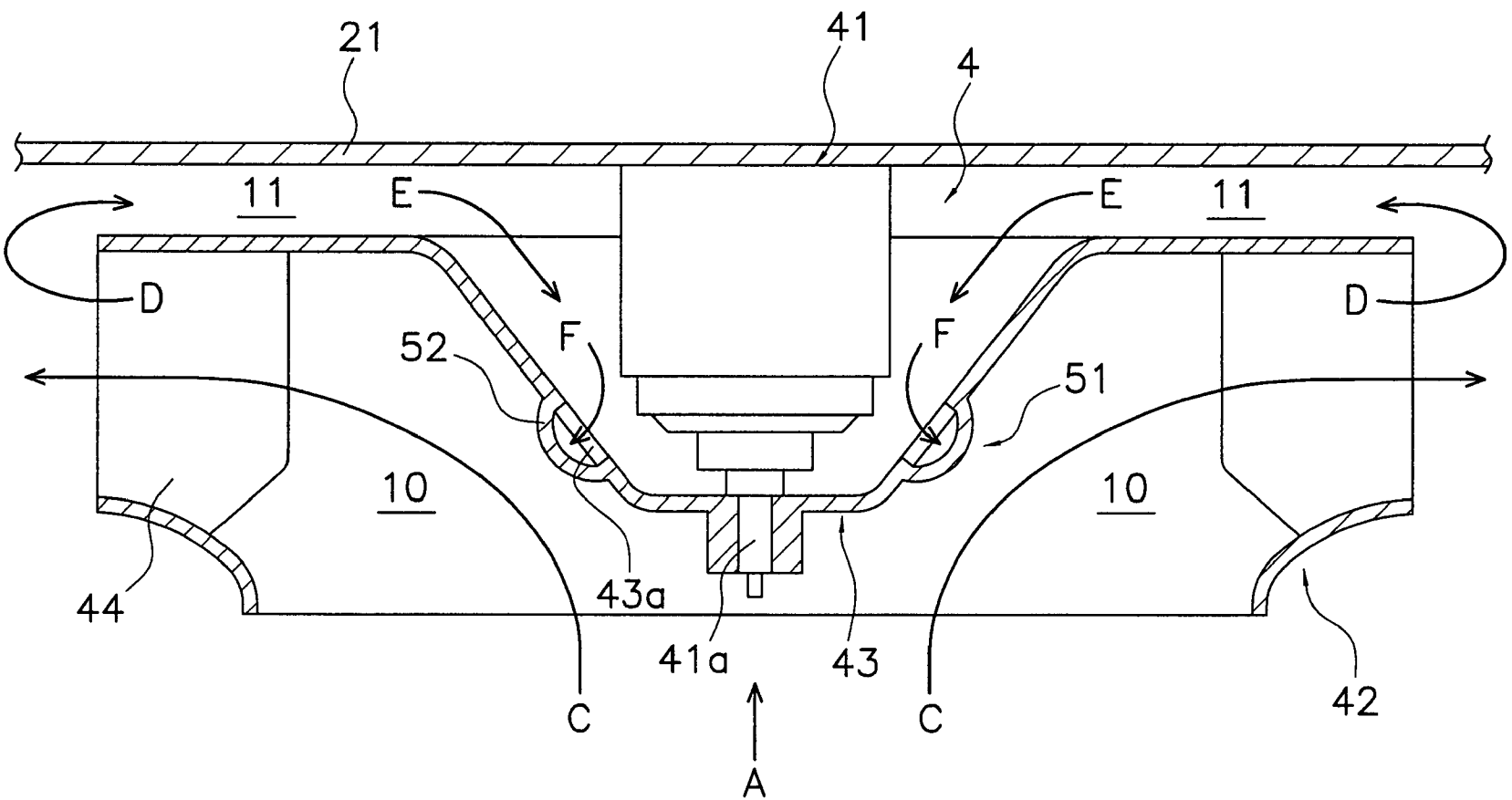
FIG. 3 is an enlarged view of the centrifugal fan shown in FIG. 2.
Figure 4:
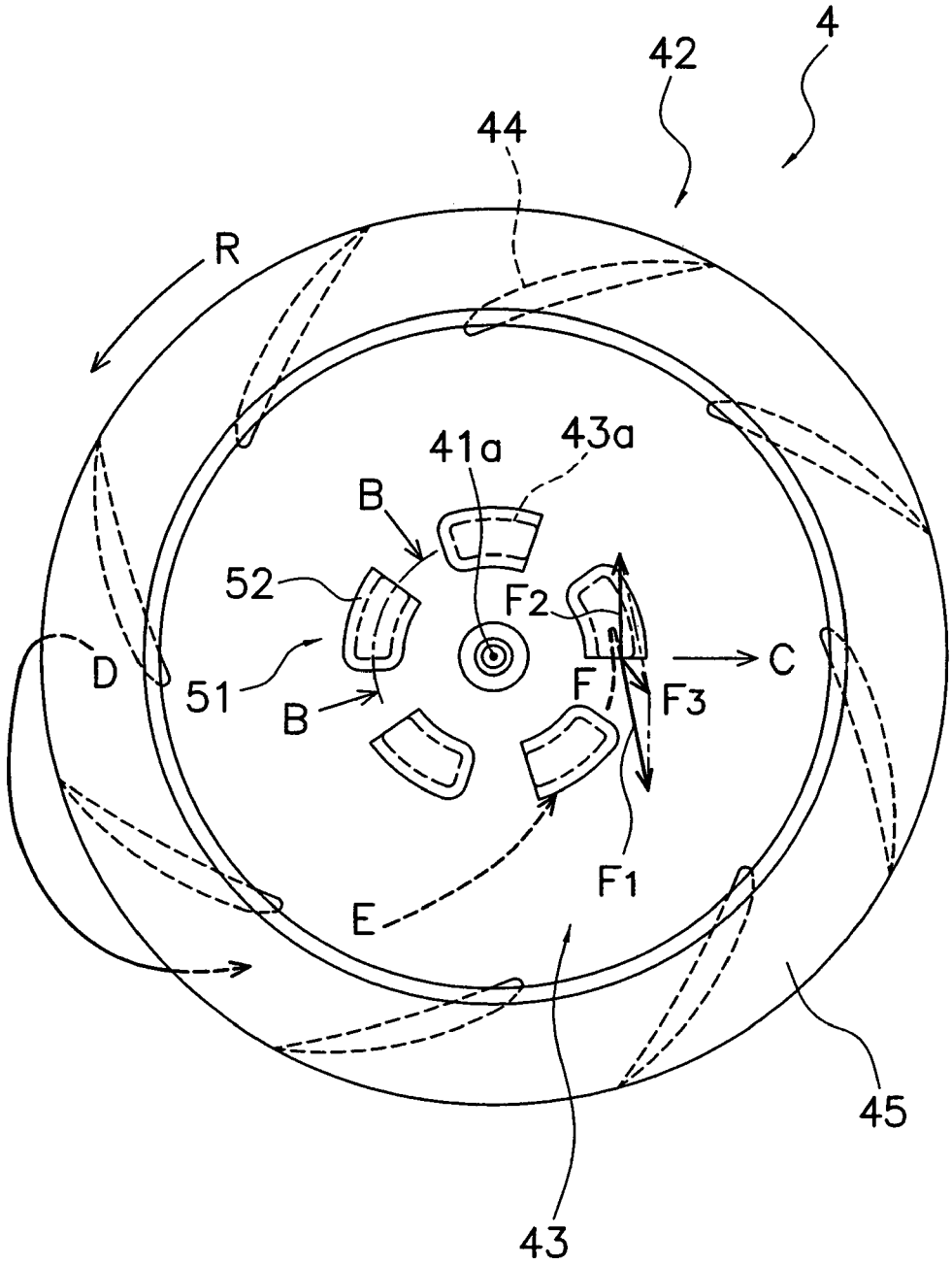
FIG. 4 is an auxiliary view taken along the arrow A shown in FIG. 3.
Figure 5:
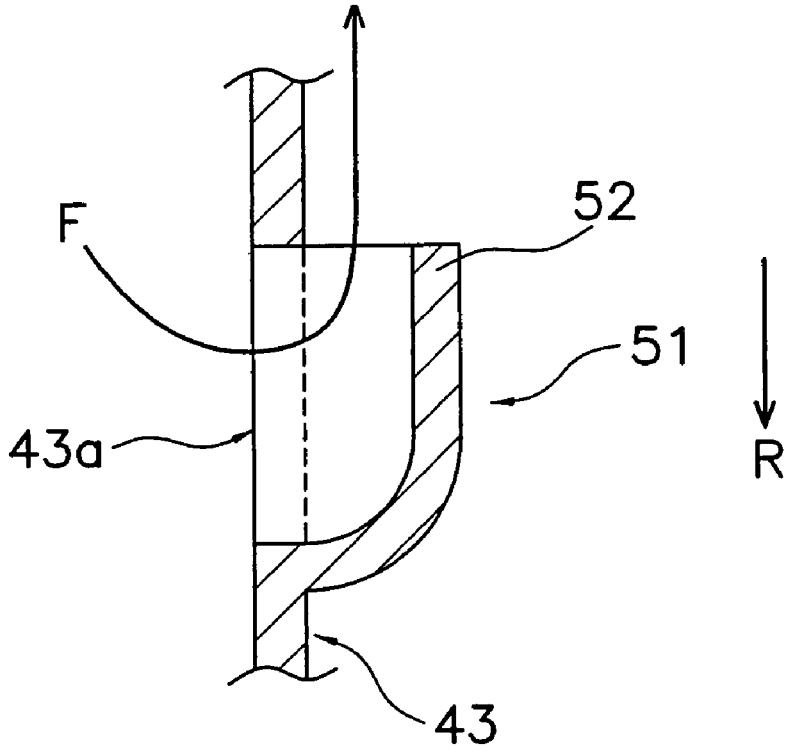
FIG. 5 is a cross-sectional view taken along the B-B line shown in FIG. 4.

The following explains the constitution of the motor cooling mechanism 51, referencing FIG. 3 through FIG. 5. Herein, FIG. 3 is an enlarged view of the centrifugal fan 4 in FIG. 2. FIG. 4 is an auxiliary view taken along A in FIG. 3. FIG. 5 is a cross-sectional view taken along B-B in FIG. 4. Furthermore, an arrow R in FIG. 4 depicts the rotational direction of the turbo impeller 42 (i.e., the hub 43) of the centrifugal fan 4.

The motor cooling mechanism 51 has a cooling air hole 43*a*, and an air guide 52 provided corresponding to the cooling air hole 43*a*.

The cooling air hole 43*a* is a hole provided in the hub 43 for guiding to the vicinity of the fan motor 41*a* portion of the air blown out toward the outer peripheral side by the turbo impeller 42. In the present embodiment, the cooling air hole 43*a* is a long hole and a plurality thereof (five holes in the present embodiment) are formed arrayed concentrically with the hub 43. In addition, the cooling air holes 43*a* are formed on the inner peripheral side of the radial position of the blades 44.

The air guide 52 can guide the air that flows from the upper surface side of the cooling air holes 43*a* (fan motor side) to the lower surface side of the hub 43 so that it blows out in the counter R direction. In the present embodiment, the air guide 52 is a half-pipe shaped part provided so that it covers each of the cooling air holes 43*a* from the lower surface side of the hub 43 (the air inlet side), and an opening is formed in the counter R direction side thereof. In addition, the air guide 52 is formed integrated with the hub 43.

(3) Operation of the Air Conditioner

The following explains the operation of the air conditioner 1, referencing FIG. 2 through FIG. 5.

First, when operation starts, the fan motor 41 is driven, and the turbo impeller 42 of the centrifugal fan 4 rotates. In addition to the driving of the fan motor 41, refrigerant also circulates in the heat exchanger 6. Herein, the heat exchanger 6 functions as an evaporator during cooling operation, and as a condenser during heating operation. Further, attendant with the rotation of the turbo impeller 42, the air inside the air conditioned room is sucked in from the lower side of the centrifugal fan 4 from the air inlet 31 of the decoration panel 3 via the filter 33 and the bell mouth 5. This air is blown out toward the outer periphery side by the turbo impeller 42, reaches the heat exchanger 6, is cooled or heated in the heat exchanger 6, and is then blown out toward the room interior from each of the air outlets 32, thereby either cooling or heating the room interior (refer to the arrow C in FIG. 2 and FIG. 3).

During the abovementioned operation, a portion of the air blown out from the turbo impeller 42 toward the outer peripheral side, particularly the air flowing across the upper part of the main air passageway 10, reaches the inner surface of the heat exchanger 6, as shown in FIG. 2 and FIG. 3, whereupon it reverses direction upward and is introduced to a branch air passageway 11 between the top plate 21 and the hub 43 (refer to the arrow D in FIG. 2 and FIG. 3). The air that passes through this branch air passageway 11 reaches the vicinity of the fan motor 41, and its temperature is raised by the action of cooling the fan motor 41 (refer to the arrow E in FIG. 3). Further, the air used to cool the fan motor 41 returns to the main air passageway 10 from the cooling air holes 43*a* and the air guide 52 formed in the hub 43, and merges with the air flow (refer to the arrow C in FIG. 3) that is sucked in from the air inlet 31 and flows in the main air passageway 10 (refer to the arrow F in FIG. 3).

Herein, the air that blew out toward the outer peripheral side from the turbo impeller 42 has a revolving direction velocity in the R direction, as shown in FIG. 4, is consequently introduced to the branch air passageway 11, passes through the vicinity of the fan motor 41 and, furthermore, has a revolving direction velocity in the R direction even when it returns from the cooling air holes 43*a* to the main air passageway 10 (refer to the arrows D, E, F in FIG. 4).

However, because the air guide 52 is open on the counter R direction side, the air that passes through the vicinity of the fan motor 41 is blown out from the cooling air holes 43*a* to the main air passageway 10 side, at which time it is guided so that its revolving direction velocity decreases. Specifically, as shown in FIG. 4, the flow of the air that passes through the cooling air holes 43*a* is changed to a flow in the counter R direction with respect to the hub 43 (refer to the arrow F in FIG. 5) by the air guide 52, and forms a flow having a velocity vector $F_1$ with respect to the hub 43. However, the hub 43 rotates in the R direction and, as a result, this air flow forms a flow having a velocity vector $F_3$ that combines a velocity vector $F_2$ and velocity vector $F_1$ corresponding to the rotational velocity of the hub 43, and blows out on the main air passageway 10 side.

Thus, the air guide 52 functions so that the air flow (arrow F) that returns from the cooling air holes 43*a* to the main air passageway 10 cancels out the revolving direction velocity in the R direction that it has when it flows into the air guide 52. Further, the air flow (arrow F) is formed so that it smoothly merges with the air flow (arrow C) that is sucked in from the air inlet 31 and flows with a nearly zero revolving direction velocity as far as the vicinity of the front edge part of the blade 44.

(4) Characteristics of the Air Conditioner

Compared with a fan motor cooling mechanism 951 of a centrifugal fan 904 built into a conventional air conditioner 901, the centrifugal fan 4 of the air conditioner 1 according to the present embodiment, and more particularly the fan motor cooling mechanism 51 provided in the centrifugal fan 4, has the following characteristics.

Figure 6:
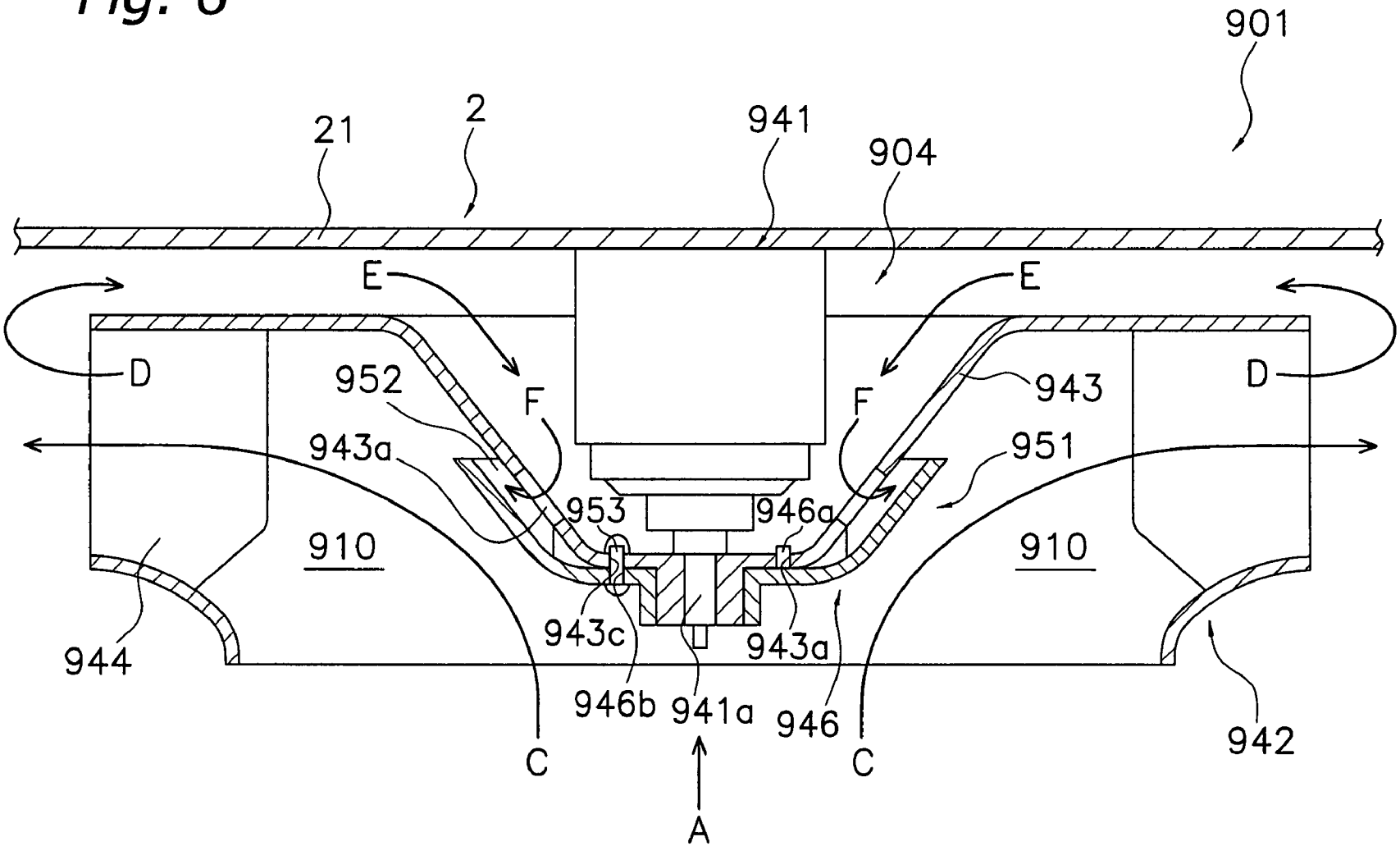
FIG. 6 depicts a conventional example of a centrifugal fan of an air conditioner, and corresponds to FIG. 3.
Figure 7:
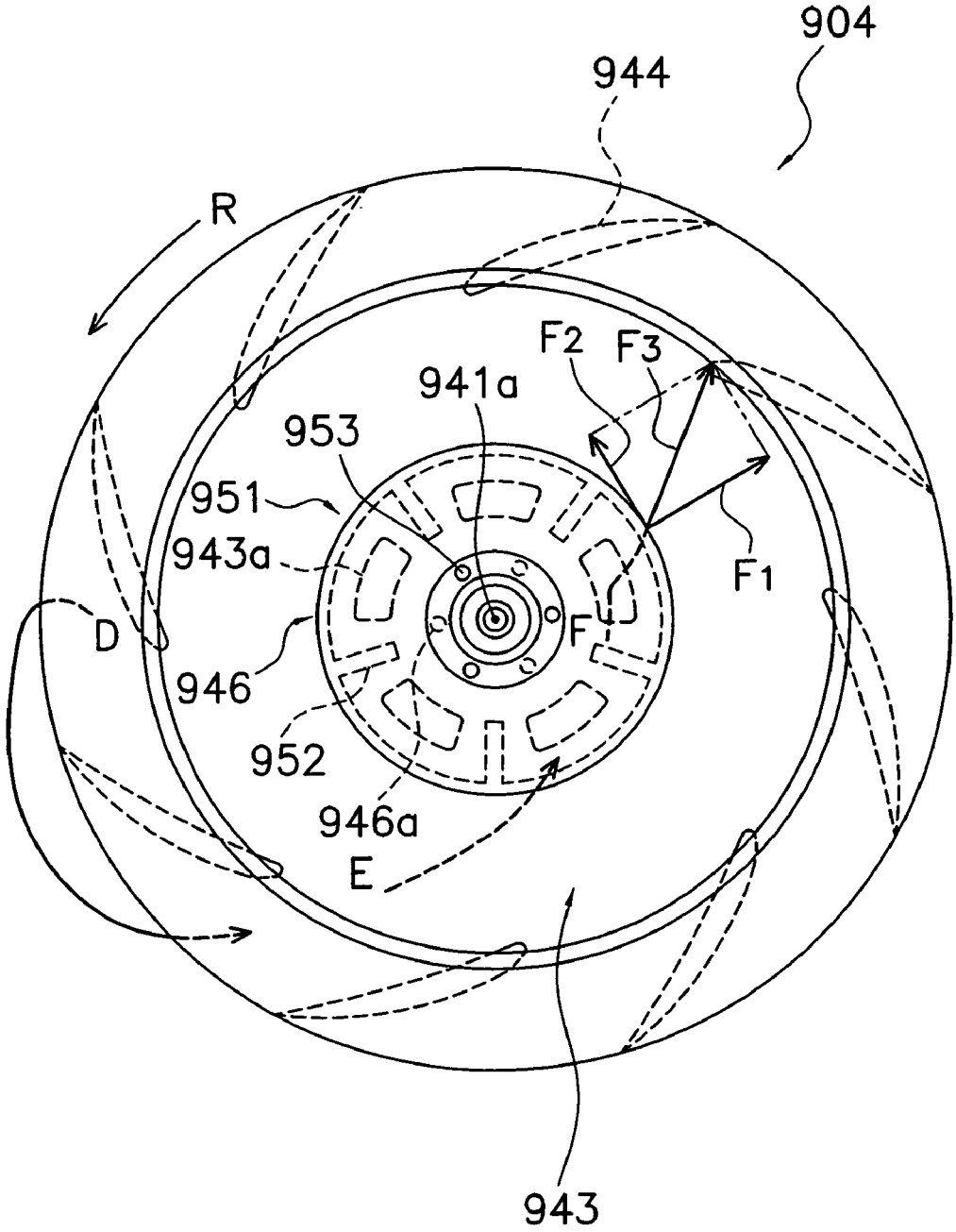
FIG. 7 is an auxiliary view taken along the arrow A shown in FIG. 6.

The centrifugal fan 904 of the conventional air conditioner 901 will first be explained. In the centrifugal fan 904 of the conventional air conditioner 901, a hub cover 946 is fixed unrotatably relative to a hub 943 so that it covers a cooling air hole 943*a* of the hub 943 from the lower side as shown in FIG. 6 and FIG. 7. Herein, the hub 943 has a plurality (three in the present embodiment) of positioning holes 943*b* formed between cooling air holes 943*a* and a rotary shaft 941*a* in the radial direction, and screw holes 943*c* provided between the positioning holes 943*b* in the circumferential direction. However, the hub cover 946 has a positioning pin 946*a* that protrudes toward the side of the fan motor provided opposing the positioning hole 943*a*, and a screw hole 946*b*, wherein a screw 953 provided so that it opposes the screw hole 943*c* is inserted. Thereby, the hub cover 946 is fixed so that it rotates integrated with the hub 943.

The hub cover 946 is arranged spaced apart from the surface formed by the cooling air holes 943*a* of the hub 943, and the outer peripheral part thereof is open toward a main air passageway 910. Furthermore, the hub cover 946 has a plurality of guide blades 952 provided between the cooling air holes 943*a* in the circumferential direction and that are provided so that they protrude radially.

The fan motor cooling mechanism 951 of the centrifugal fan 904 includes the cooling air holes 943*a* of the hub 943, and guide blades 952 of the hub cover 946.

In the constitution of the fan motor cooling mechanism 951, the air that is sucked in from the air inlet along the rotary shaft 941*a* direction flows in the arrow C direction shown in FIG. 6, the same as in the present embodiment. In addition, it is the same as the present embodiment even with regard to the point that a portion of the air blown out toward the outer periphery side by a turbo impeller 942 passes between the top plate 21 of the casing 2 and the hub 943, and is blown out from the cooling air holes 943*a* into the turbo impeller 942 interior, (refer to the arrows D, E, F in FIG. 6 and FIG. 7). However, because the air flow (arrow F) that is blown out from the cooling air holes 943*a* into the interior of the turbo impeller 942 is merely blown out nearly radially with respect to the hub 943 by the guide blades 952, as shown in FIG. 7 (refer to the velocity vector $F_1$ in FIG. 7), the revolving direction velocity, which has a velocity vector $F_3$ (a velocity vector that combines the velocity vector $F_2$ and the velocity vector $F_1$ corresponding to the rotational velocity of the hub 943), unfortunately grows larger than the revolving direction velocity having a velocity vector $F_3$ of the air flow blown out from the cooling air holes 943*a* in the motor cooling mechanism 951 of the present embodiment.

As described above, compared to a conventional fan motor cooling mechanism 951, the fan motor cooling mechanism 51 of the centrifugal fan 4 according to the present embodiment of the present invention can guide the flow of air (arrow F) blown out from the cooling air holes 43*a* to the side of the hub 43 opposite the fan motor so that the revolving direction velocity of the flow decreases. Thereby, any increase in the noise level of the centrifugal fan 4, generated when the flow of air blown out from the cooling air holes 43*a* to the side of the hub 43 opposite the fan motor merges with the flow of air that flows through the main air passageway 10, is suppressed; furthermore, any increase in the noise level of the air conditioner 1 is also suppressed. Specifically, compared with the abovementioned conventional example, the present invention can reduce the noise level by approximately 1 dB, while obtaining a prescribed air volume and fan motor cooling performance.

Because the air guide 52 is formed integrated with the hub 43 in the present embodiment, it is possible to reduce the number of parts constituting the turbo impeller 42.

Second Embodiment

Figure 8:
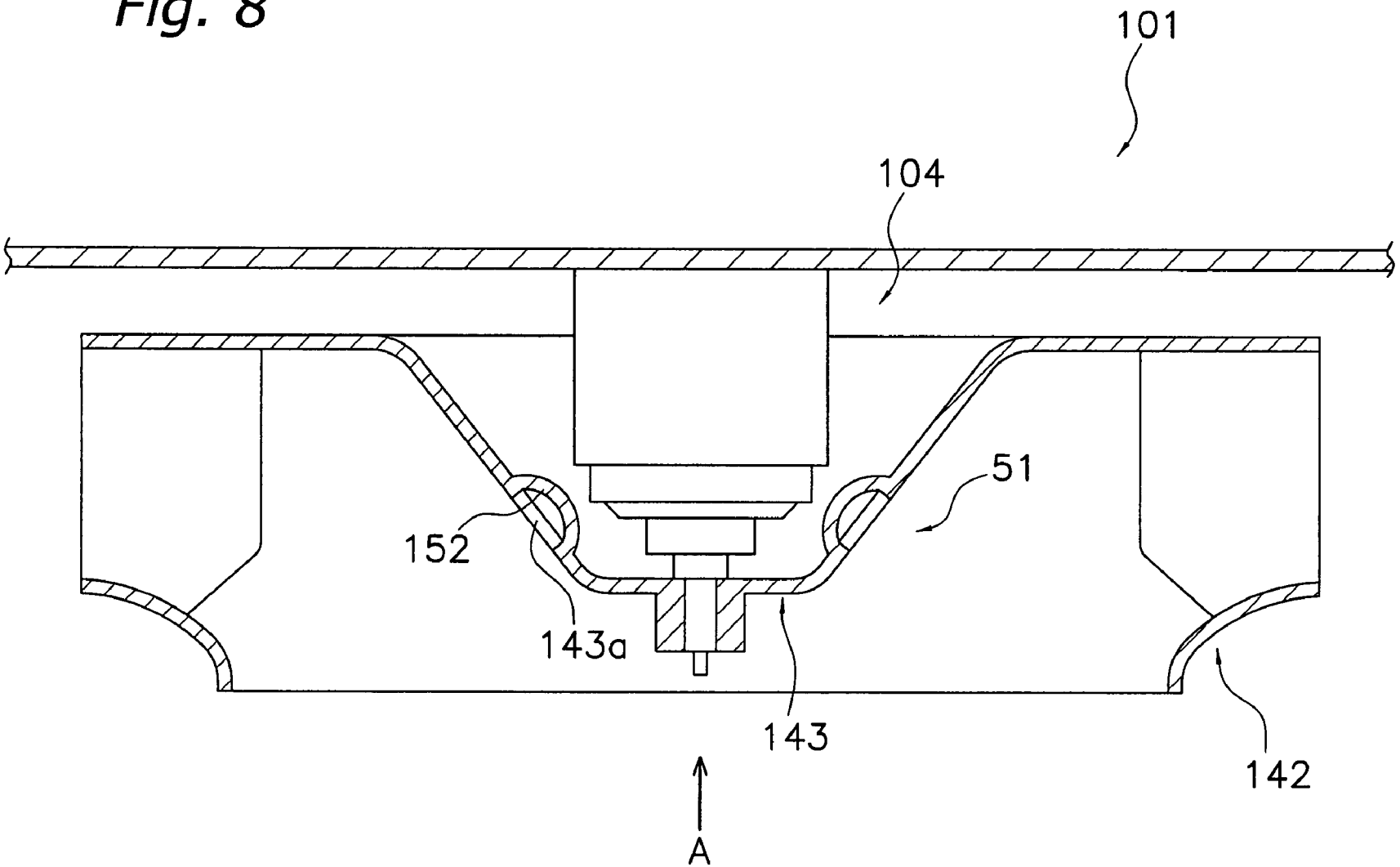
FIG. 8 depicts the centrifugal fan of the air conditioner according to the second embodiment, and corresponds to FIG. 3.
Figure 9:
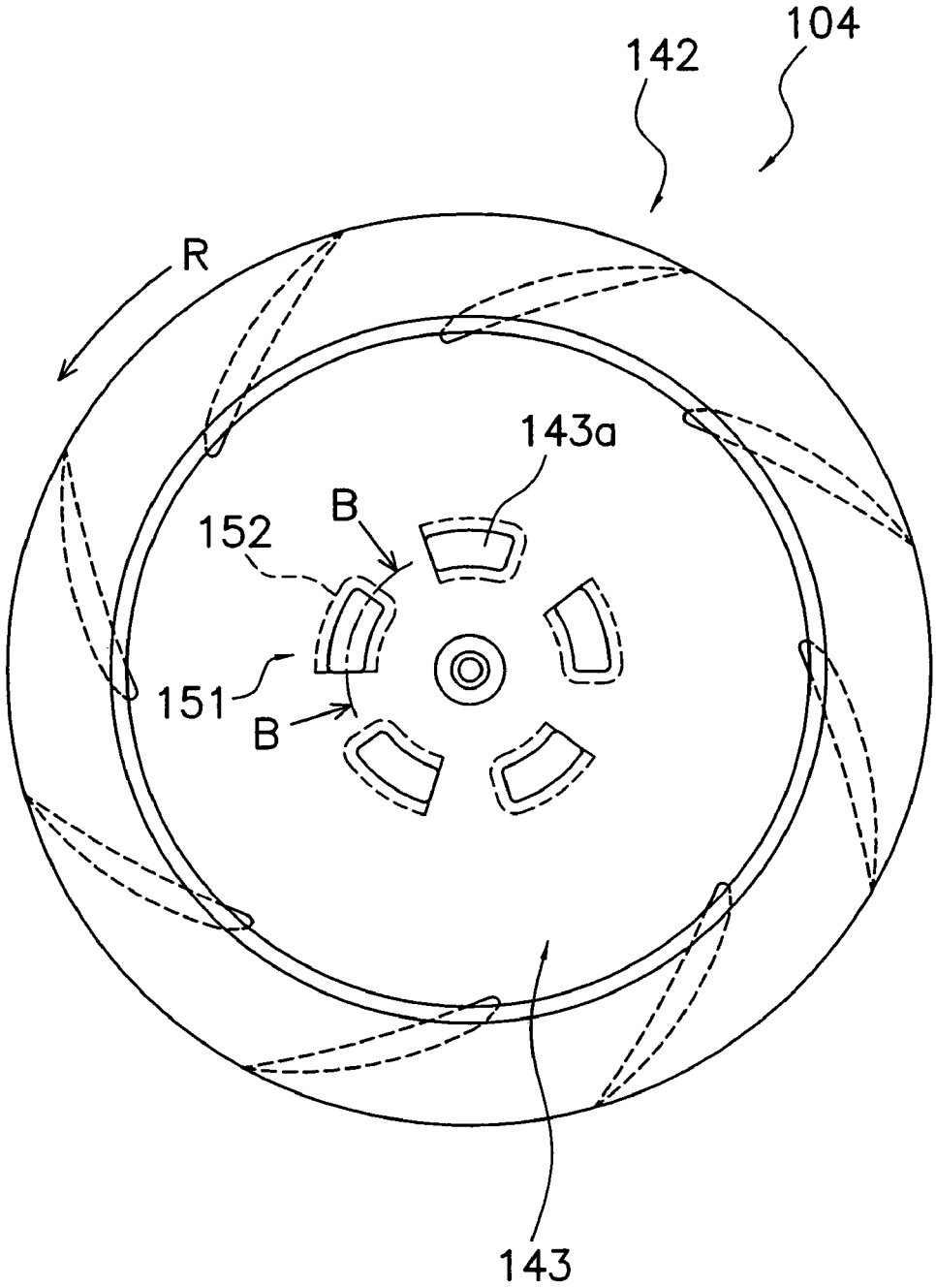
FIG. 9 is an auxiliary view taken along the arrow A shown in FIG. 8.
Figure 10:
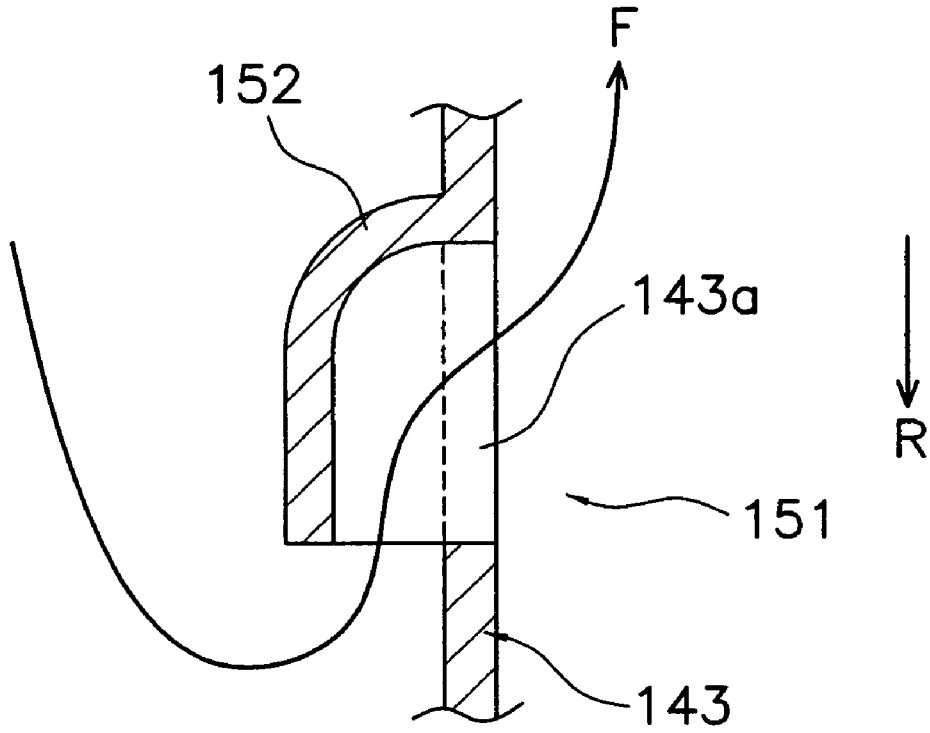
FIG. 10 is a cross-sectional view taken along the B-B line shown in FIG. 9.

Although the air guide 52 of the motor cooling mechanism 51 in the first embodiment is provided on the lower surface side of the hub 43, it may also be provided on the upper surface side. Specifically, a fan motor cooling mechanism 151 of a centrifugal fan 104 built into an air conditioner 101 of the present embodiment has, as shown in FIG. 8 through FIG. 10, cooling air holes 143*a* formed in the hub 143 of the centrifugal fan 104, and an air guide 152 provided corresponding to the cooling air holes 143*a*.

The cooling air hole 143*a* is a hole provided in the hub 143 for guiding to the vicinity of the fan motor a portion of the air blown out toward the outer peripheral side by the turbo impeller 142, the same as in the first embodiment. In the present embodiment, the cooling air hole 143*a* is a long hole and a plurality thereof (five holes in the present embodiment) are formed arrayed concentrically with the hub 143.

In addition, in the present embodiment, the air guide 152 is a half-pipe shaped part provided so that it covers each of the cooling air holes 143*a* from the upper surface side of the hub 143 (the fan motor side), and an opening is formed in the R direction side thereof. Thereby, the air that flows from the upper surface side of the cooling air holes 143*a* (fan motor side) to the lower surface side of the hub 143 can be guided so that it blows out toward the counter R direction (refer to the arrow F in FIG. 10), and any increase in the noise level can be suppressed, the same as in the first embodiment.

Third Embodiment

Figure 11:
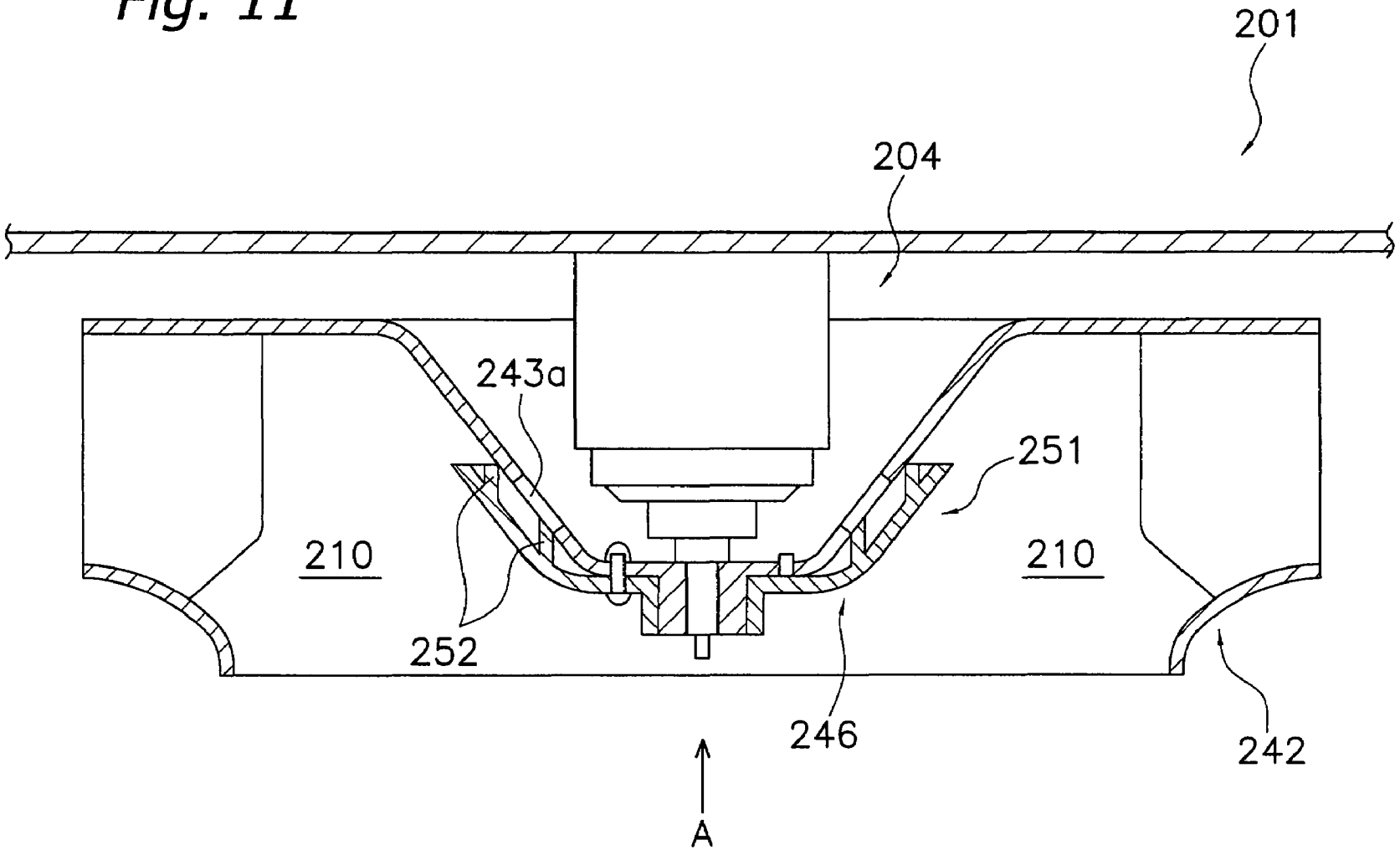
FIG. 11 depicts the centrifugal fan of the air conditioner according to the third embodiment, and corresponds to FIG. 3.
Figure 12:
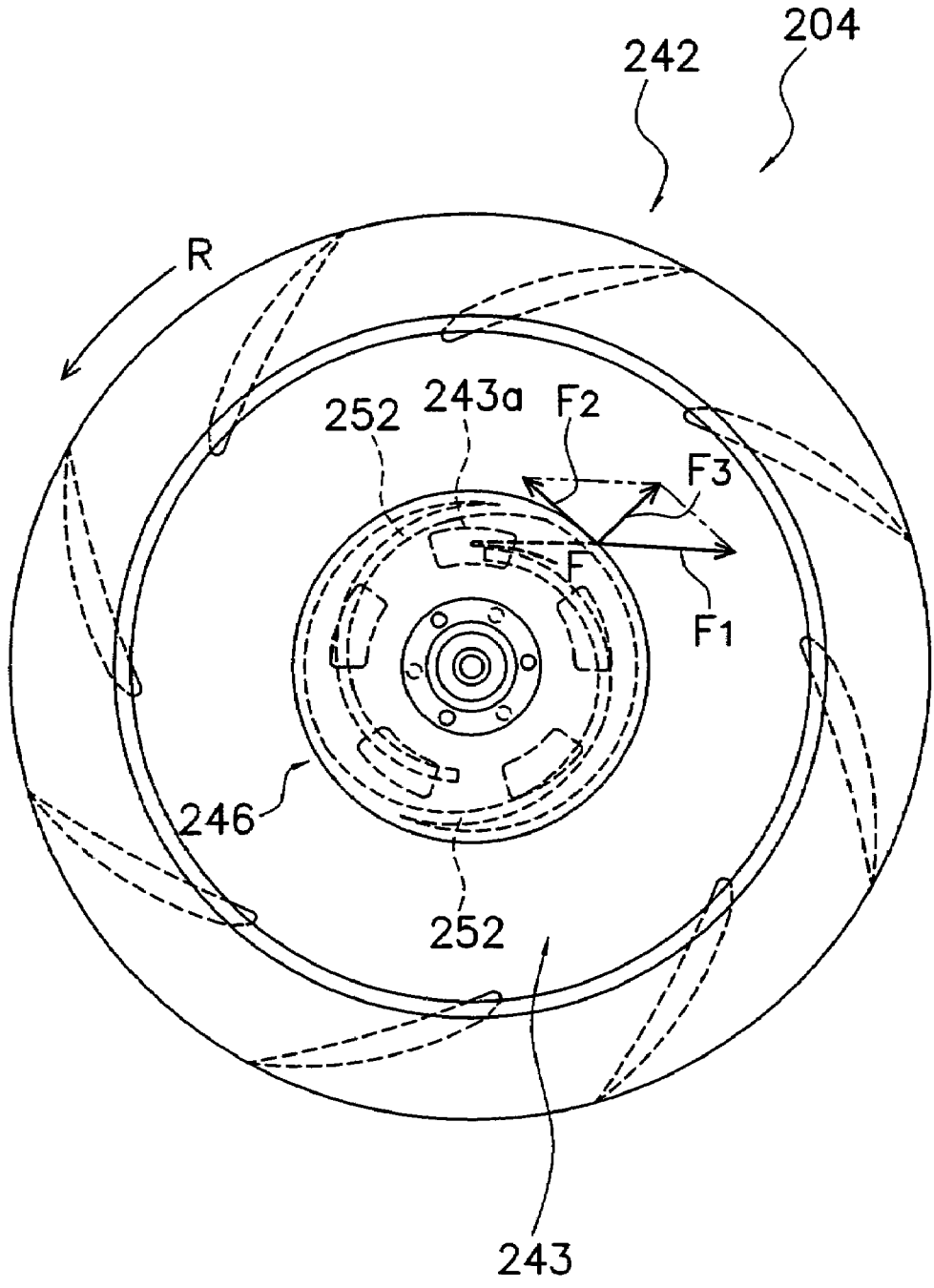
FIG. 12 is an auxiliary view taken along the arrow A shown in FIG. 11.

In the first and second embodiments, the air guides 52, 152 of the fan motor cooling mechanisms 51, 151 were formed integrated with the hub 43, 143; however, they may also be provided in the hub cover, the same as the motor cooling mechanism 951 in the conventional example. Specifically, a fan motor cooling mechanism 251 of a centrifugal fan 204 built into an air conditioner 201 of the present embodiment includes, as shown in FIG. 11 and FIG. 12, cooling air holes 243*a* formed in a hub 243, and a volute blade-shaped guide blade 252 (air guide) provided in a hub cover 246. The hub cover 246 is fixed so that it rotates integrated with the hub 243 using a screw and a positioning pin, the same as the hub cover 946 in the conventional example.

The guide blade 252 is a plurality (two in the present embodiment) of volute blades that are inclined rearward with respect to the rotational direction (R direction) of the hub 243. Thereby, unlike the guide blade 952 of the fan motor cooling mechanism 951 in the conventional example, the present embodiment can guide the air that flows from the upper surface side of the cooling air holes 243*a* (fan motor side) toward the lower surface side of the hub 243, so that it blows out toward the counter R direction.

Specifically, when the air that blows out from a turbo impeller 242 toward the outer peripheral side flows into the cooling air holes 243*a*, the same as in the first and second embodiments, as shown in FIG. 12, it has a revolving direction velocity in the R direction; however, because the guide blade 252 is inclined rearward with respect to the R direction, the orientation of the flow changes to the counter R direction with respect to the hub 243 (refer to the arrow F in FIG. 12), and forms a flow having a velocity vector $F_1$ with respect to the hub 243. However, because the hub 243 rotates in the R direction, the air flow consequently forms a flow having a velocity vector $F_3$ that combines the velocity vector $F_2$ and the velocity vector $F_1$ that corresponds to the rotational velocity of the hub 243, and is blown out on the main air passageway 210 side.

Thus, the same as the first and second embodiments, the guide blade 252 functions to cancel out the revolving direction velocity in the R direction that the air flow (arrow F) returning from the cooling air holes 243*a* to the main air passageway 210 has when it flows into the guide blade 252, and any increase in the level of noise is consequently suppressed, the same as in the first and second embodiments.

In addition, the present embodiment obtains a turbo impeller 242 capable of suppressing any increase in the noise level by just changing the shape of the guide blade provided in the hub cover 246 from the conventional guide blade 952 to the guide blade 252, without changing the structure of the hub 943 of the turbo impeller 942 in the conventional example.

Fourth Embodiment

Figure 13:
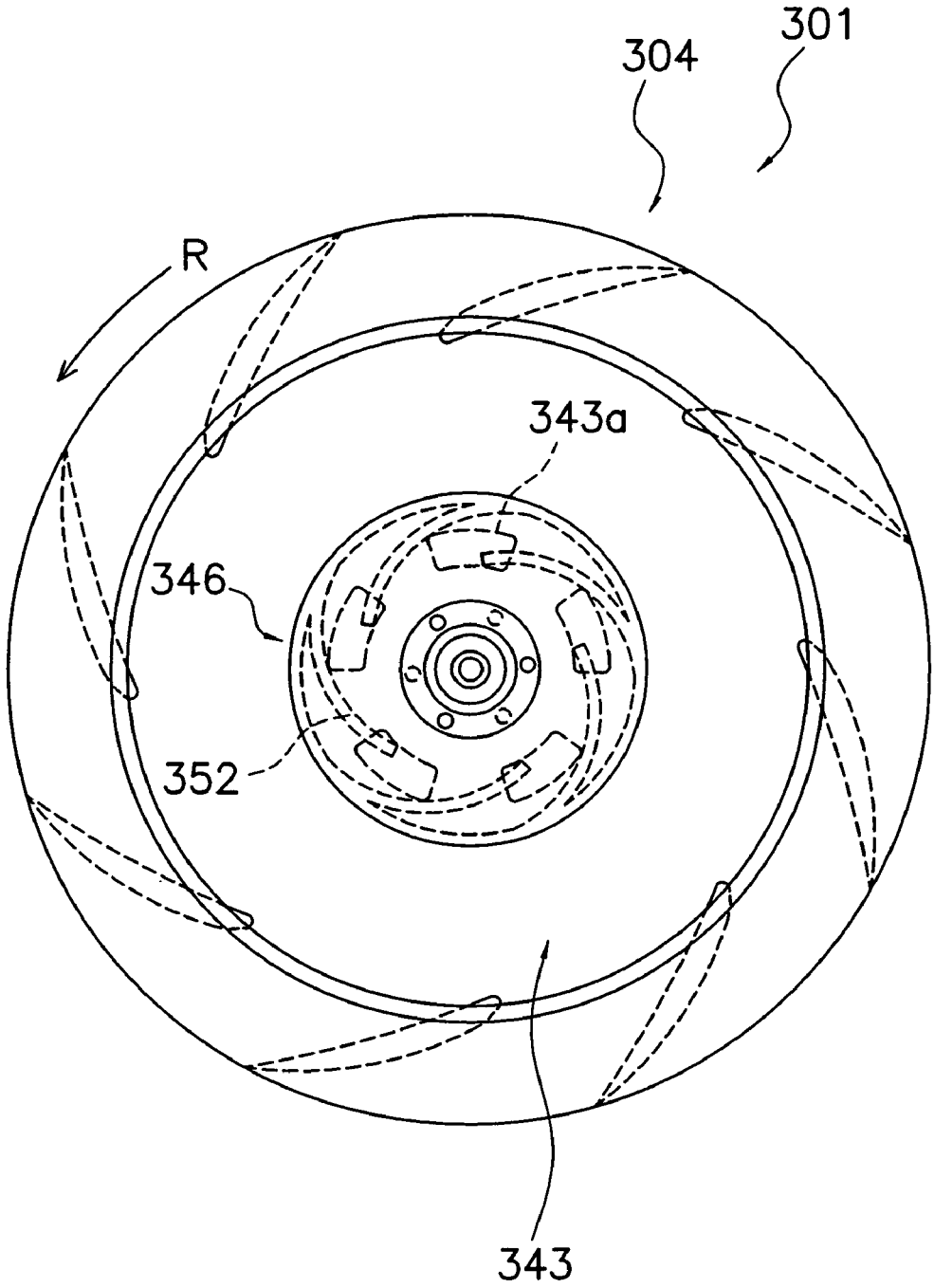
FIG. 13 depicts the centrifugal fan of the air conditioner according to the fourth embodiment, and corresponds to FIG. 4.

The guide blade 252 in the third embodiment was volute blade-shaped, but may also be another shape, such as a turbo blade. Specifically, a fan motor cooling mechanism 351 of a centrifugal fan 304 built into an air conditioner 301 of the present embodiment includes, as shown in FIG. 13, cooling air holes 343*a* formed in a hub 343, and a turbo blade-shaped guide blade 352 (air guide) provided in a hub cover 346.

The guide blade 352 is a plurality of turbo blades (five in the present embodiment) that are inclined rearward with respect to the rotational direction (R direction) of the hub 343. Thereby, the air flowing from the upper surface side (fan motor side) of the cooling air holes 343*a* toward the lower surface side of the hub 343 can be guided so that it blows out toward the counter R direction, obtaining an effect the same as the third embodiment.

Fifth Embodiment

Figure 14:
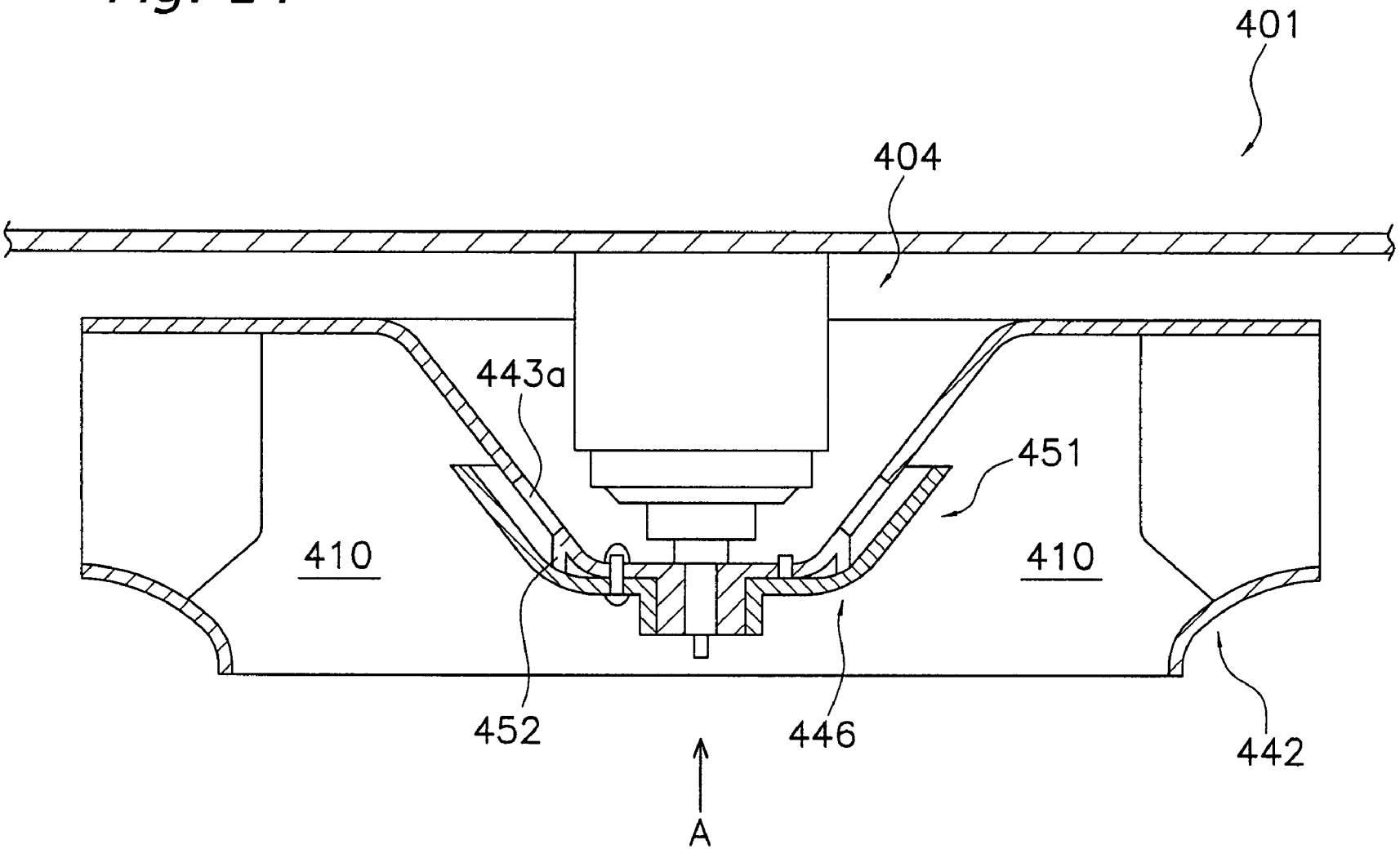
FIG. 14 depicts the centrifugal fan of the air conditioner according to the fifth embodiment, and corresponds to FIG. 3.
Figure 15:
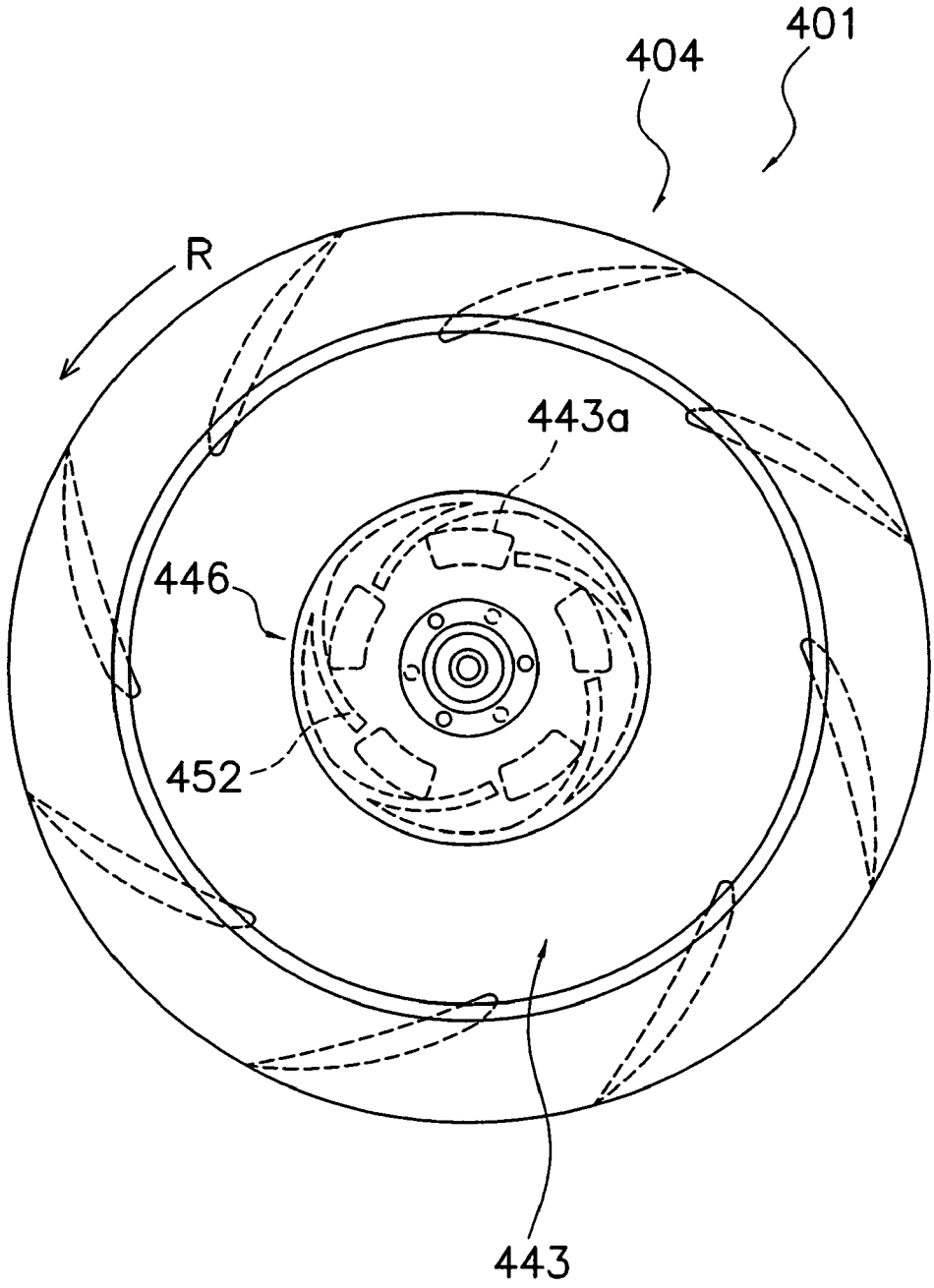
FIG. 15 is an auxiliary view taken along the arrow A shown in FIG. 14.

In the third and fourth embodiments, the air guides 252, 352 were formed in the hub covers 246, 346; however, they may also be formed in the hubs 243, 343. Specifically, a fan motor cooling mechanism 451 of a centrifugal fan 404 built into an air conditioner 401 of the present embodiment includes, as shown in FIG. 14 and FIG. 15, cooling air holes 443*a* formed in a hub 443, and a turbo blade-shaped guide blade 452 (air guide) provided in a hub cover 446, the same as in the fourth embodiment.

Even such a constitution can guide the air that flows from the upper surface side (fan motor side) of the cooling air holes 443*a* toward the lower surface side of the hub 443 so that it blows out toward the counter R direction, and consequently can obtain the effect of suppressing any increase in the noise level, the same as the third and fourth embodiments.

In addition, the present embodiment provided an illustrative example for the case in which a turbo blade-shaped guide blade 452 (air guide) is provided in the hub 446; however, the present embodiment is not limited thereto, and a volute blade-shaped guide blade may be provided in the hub, the same as in the third embodiment.

Other Embodiments

The above embodiments of the present invention were explained based on the drawings, but specific configurations are not limited to these embodiments, and may vary in scope without violating the spirit of the present invention.

(1) The aforementioned embodiments were explained as examples of a turbo-type centrifugal fan; however, the present invention may be applied to various types of centrifugal fans, provided that it is a type that uses a portion of the air once it is blown out from the centrifugal fan to cool the fan motor.

(2) The aforementioned embodiments provided an explanation of a ceiling-embedded type air conditioner as an example; however, the present embodiment may also be applied to various types of air conditioners, provided that they are provided with a centrifugal fan wherein an impeller and a fan motor are arranged inside the casing.

INDUSTRIAL FIELD OF APPLICATION

The use of the present invention obtains a prescribed cooling effect in a fan motor and enables the suppression of any increase in the noise level in a centrifugal fan that sucks in air from the rotary shaft direction and blows out air in a direction that intersects the rotary shaft, and in an air conditioner provided therewith.

What is claimed is:

1. A centrifugal fan comprising:

a rotary shaft;

an electric motor configured to rotate said rotary shaft;

a main plate having a cooling air hole and being coupled to and rotationally driven by said rotary shaft;

a plurality of blades provided on the surface of said main plate on a side opposite said electric motor and positioned radially outward from said cooling air hole, said main plate and said blades being configured to suck in air from a rotary shaft direction and blow air out in a direction that intersects said rotary shaft;

an air guide coupled to said main plate for rotation therewith proximate said cooling air hole such that, after a portion of the blown out air has been guided to the vicinity of said electric motor and has cooled said electric motor, guides the air flow so that it is blown out toward the side of said main plate in the counter rotational direction when blown out from said cooling air hole to the side of said main plate opposite said electric motor;

a cover being coupled to said rotary shaft for rotation with said main plate covering said cooling air hole from the side opposite said electric motor, and being provided to rotate integrally with said main plate;

said air guide being formed between said cover on an electric motor side thereof, and said main plate on the side opposite said electric motor, and said air guide having a blade shape inclined rearwards in the rotational direction of said cover.

2. The centrifugal fan as recited in claim 1, wherein said air guide has a volute blade shape.

3. The centrifugal fan as recited in claim 1 wherein said air guide is formed in said cover.

4. The centrifugal fan as recited in claim 2 wherein said air guide is formed in said cover.

5. An air conditioner comprising:

a centrifugal fan having:

a rotary shaft, an electric motor configured to rotate said rotary shaft, a main plate having a cooling air hole and being coupled to and rotationally driven by said rotary shaft, a plurality of blades provided on the surface of said main plate on a side opposite an electric motor and positioned radially outward from said cooling air hole, said main plate and said blades being configured to suck in air from a rotary shaft direction and blow air out in a direction that intersects said rotary shaft, an air guide coupled to said main plate for rotation therewith proximate said cooling air hole such that, after a portion of the blown out air has been guided to the vicinity of said electric motor and has cooled said electric motor, guides the air flow so that it is blown out toward the side of said main plate in the counter rotational direction when blown out from said cooling air hole to the side of said main plate opposite said electric motor, and a cover being coupled to said rotary shaft for rotation with said main plate covering said cooling air hole from the side opposite said electric motor, and being provided to rotate integrally with said main plate and said air guide is formed between said cover and said main plate;

a heat exchanger arranged on the outer peripheral side of said centrifugal fan; and a casing housing said centrifugal fan and said heat exchanger, said air guide being formed between said cover on an electric motor side thereof, and said main plate on the side opposite said electric motor, and said air guide having a blade shape inclined rearwards in the rotational direction of said cover.

6. The air conditioner as recited in claim 5 wherein said air guide has a volute blade shape.

7. The air conditioner as recited in claim 5 wherein said air guide is formed in said cover.

8. The air conditioner as recited in claim 6 wherein said air guide is formed in said cover.

* * * * *